US010323378B2

(12) United States Patent
Piontkowski et al.

(10) Patent No.: US 10,323,378 B2
(45) Date of Patent: Jun. 18, 2019

(54) EARTHQUAKE DYNAMIC ARCHES WITH STACKED WEDGE FOUNDATION

(71) Applicants: Shlomo Piontkowski, New York, NY (US); Sharone Piontkowski, New York, NY (US); Pnina Piontkowski, New York, NY (US); Jakob Gilbert, Roslyn Heights, NY (US)

(72) Inventors: Shlomo Piontkowski, New York, NY (US); Sharone Piontkowski, New York, NY (US); Pnina Piontkowski, New York, NY (US); Jakob Gilbert, Roslyn Heights, NY (US)

( * ) Notice: Subject to any disclaimer, the term of this patent is extended or adjusted under 35 U.S.C. 154(b) by 0 days.

(21) Appl. No.: 15/487,157

(22) Filed: Apr. 13, 2017

(65) Prior Publication Data

US 2018/0216308 A1 Aug. 2, 2018

Related U.S. Application Data

(60) Provisional application No. 62/322,062, filed on Apr. 13, 2016.

(51) Int. Cl.

| | |
|---|---|
| ***E04B 1/32*** | (2006.01) |
| ***E02D 27/32*** | (2006.01) |
| ***E04B 1/98*** | (2006.01) |
| ***E04H 9/02*** | (2006.01) |
| ***E02D 27/01*** | (2006.01) |

(52) U.S. Cl.

CPC ..... *E02D 27/32* (2013.01); *E02D 27/016* (2013.01); *E04B 1/3205* (2013.01); *E04B 1/98* (2013.01); *E04H 9/021* (2013.01); *E02D 2200/146* (2013.01); *E02D 2200/1678* (2013.01); *E02D 2600/20* (2013.01); *E04B 2103/02* (2013.01)

(58) Field of Classification Search

CPC . E02D 27/32; E02D 27/016; E02D 2200/146; E02D 2200/1678; E04B 1/3205; E04B 1/98; E04H 9/021

See application file for complete search history.

(56) References Cited

U.S. PATENT DOCUMENTS 1,306,246 A * 6/1919 Bried ..... E04C 1/395 404/39
2,961,839 A * 11/1960 Aresti ..... E02D 27/32 405/231
3,390,502 A * 7/1968 Carroll ..... E04B 2/06 52/275

(Continued)

*Primary Examiner* — Paola Agudelo
(74) *Attorney, Agent, or Firm* — Brad M. Behar & Associates, PLLC

(57) ABSTRACT

The present invention is an arch/building support system comprising two (or more) opposing wedges, at least one located at the base of each side of the arch, with the bases of the opposing wedges facing each other, the opposing wedges connected to each other by a semi-rigid flexible rod or rods. In a building structure, the flexible member could be rebar(s) made of one or various materials (metal, plastic, nylon etc.) with various degree of elasticity. The rebars could envelop the structure (around the outside or shell) or reside within it, and may also incorporate some sort of spring mechanism. The rebar(s) are anchored to the upper wedge on each side of the arch, but need not be, and could instead be anchored to the ground.

8 Claims, 11 Drawing Sheets

When the DAS are connected by a 'semi-rigid' system that is in an arch form, the shift and rotation of the wedges creates a stable arch that remains the same height as the semi-rigid arch, but decreases in arch base length.

(56) References Cited

U.S. PATENT DOCUMENTS 3,612,470 A * 10/1971 Car ..... E04G 13/06 182/206
3,798,851 A * 3/1974 Utahara ..... E04B 1/3205 135/124
4,306,393 A * 12/1981 Shelton ..... E04H 4/0081 52/169.7
4,644,710 A * 2/1987 Lippe ..... E04B 1/3205 52/223.7
4,879,157 A * 11/1989 Pankatz ..... E04B 1/7654 428/157
5,873,206 A * 2/1999 Roberts ..... E04B 1/3205 52/245
6,240,686 B1 * 6/2001 Mill ..... E04B 1/3205 52/223.1
6,543,969 B1 * 4/2003 Adam ..... E02D 29/025 405/262
8,678,704 B1 * 3/2014 Smith ..... E02B 3/14 405/16
9,828,760 B2 * 11/2017 Drew ..... E21D 11/08
9,945,641 B2 * 4/2018 Stranner ..... B32B 17/10045
10,036,161 B1 * 7/2018 Roberts ..... E04B 2/22
2003/0159370 A1 * 8/2003 Drew ..... E01D 4/00 52/89
2006/0230539 A1 * 10/2006 Goodman ..... A47C 19/045 5/660
2007/0259520 A1 * 11/2007 Cooper ..... E02D 27/01 438/653
2012/0073428 A1 * 3/2012 Milinkovic ..... B28B 1/087 89/36.04
2014/0290153 A1 * 10/2014 Christensen ..... E04B 1/3205 52/86
2015/0000216 A1 * 1/2015 Noble ..... E04B 1/3211 52/80.1
2015/0361657 A1 * 12/2015 Hejazi ..... E04H 9/027 52/167.2
2016/0319506 A1 * 11/2016 Boyce ..... E02D 27/013

* cited by examiner

Dynamic Wedges Force Vector Manipulation
Converts a Semi-Rigid System into a Rigid System When the wedges are connected by a 'semi-rigid' system, the shift and rotation of the wedges causes a stable arch to be formed.

The arch that is formed has stored potential energy in it, which when released causes a 'spring-like effect.

When the DAS are connected by a 'semi-rigid' system that is in an arch form, the shift and rotation of the wedges creates a stable arch that remains the same height as the semi-rigid arch, but decreases in arch base length.

EARTHQUAKE DYNAMIC ARCHES WITH STACKED WEDGE FOUNDATION

CROSS REFERENCE

This non-provisional patent application claims the benefit of U.S. Provisional Patent Application Ser. No. 62/322,062 filed on Apr. 13, 2016, which is expressly incorporated herein in its entirety by reference thereto.

FIELD OF THE INVENTION

The present invention relates to foundations, more specifically foundations for arch structures and buildings. The present invention relates to foundations that can reduce the likelihood, prevent to a significant degree, the collapse/failure in a building structure that would otherwise have occurred during a catastrophic event (e.g., an earthquake) without the invention. The present invention relates to a dynamic foundation system comprising movable wedge structures connected with flexible members.

BACKGROUND OF THE INVENTION

As our global society advances technologically, so does our architectural design and engineering. With time, buildings have been made more stable and resistant to the elements. However, with these advancements comes the need for funds; many countries are unable to subsidize the development of stable housing, particularly in earthquake-prone environments. Currently, the foundations of arch systems in housing in low-income areas of the world are largely unstable when facing a typical earthquake; this often leads to the collapse and complete destruction of buildings in areas including but not limited to Nepal, Indonesia, and El Salvador. By examining and analyzing the arch system created evolutionarily in the human foot, called a "semi-rigid" arch, Applicant has identified a way of creating an arch that can, when put under pressure, become more stable instead of collapsing. Forces of pressure can be countered using a "stacked dynamic wedge" foundation beneath semi-rigid arches, causing arches to become more rigid during an earthquake. Applicant has invented a more efficient foundation system than current architectural designs which will prevent failure in building structures.

Arches are architectural structures that force any weight being supported by the top of the arch to be distributed as outward instead of straight down. Homes are built with some type of arch embedded in them. In modern architecture, the currently used arch is called a "rigid arch." This includes rectangular, round, and inflexible arch support systems that, when put under pressure far beyond their intended purpose, collapse. By modeling after the human foot's "semi-rigid" arch system and using dynamic wedge bases, an architectural alternative can be presented by which houses in earthquake-prone areas are built to become more stable, rather than collapse, when put under immense strain and pressure. The present invention will allow for low-income areas to build affordable yet stable housing that will prevent collapse during earthquakes.

Human anatomy has had millions of years of evolution to get to the point it's at today. Suffice it to say, our bodies are built more complexly and efficiently than many man-made structures. Consider the human foot: it is observably an arch. However, unlike the structures seen in our buildings, it is flexible; the human foot has a certain plasticity to it, where it can be manipulated and moved when at rest, and when put under pressure, it becomes stiff and stable. The biological arch is a "dynamic arch" in that during the Gait cycle, it can become rigid when necessary, and plastic when need be. The ability to become stiff allows the foot to neutralize and counter ground forces and stabilize the body, while the plasticity of the arch allows for the foot to continue movement otherwise and act as a shock absorber.

Any arch's stability is largely based on the base upon which it is resting. In order to provide stability and prevent collapse during earthquakes, arches have been placed on foundations including springs and blocks. Alternative methods of providing stability that have been proposed are wires running between either side of the arch or reinforcements at the bottom of the arch. There are numerous methods of stabilizing structures against catastrophic failure, especially during earthquakes. Proper footings, appropriate design and material, are the common way of addressing these challenges. More elaborate structural additions in an earthquake zone are reinforced foundations for vibration and shearing force management. Layered foundation footings, giant springs, giant rollers, deep footings, soft base, and others measures can be used independently or in combination. All aim at keeping the structure (building) standing and avoiding catastrophic failure. Ultimately, these methods prove unreliable and often unstable, not to mention uneconomical. Also, none addresses a situation where the point of failure has already been reached.

None of the existing foundation designs is intended to or capable of successfully increasing the rigidity and strength of the structure upon movement. None of the existing foundation designs cause an arch to become more stable upon increased pressure in the system instead of collapsing. None of the existing foundation designs allow for movement within the arch structure in addition to movement within the foundation.

SUMMARY OF THE INVENTION

Applicant has invented an improved arch/building support system comprising a dynamic wedge system having two (or more) opposing wedges, at least one located at the base of each side of the arch, with the bases of the opposing wedges facing each other (e.g. mirror image), the opposing wedges connected to each other by a semi-rigid (flexible) rod or rods. While the invention will be described in connection with certain embodiments, it will be understood that the invention is not limited to those embodiments. To the contrary, the invention includes all alternatives, modifications and equivalents as may be included within the spirit and scope of the present invention.

The dynamic wedge foundation or stacked wedge foundation for a semi-rigid arch according to the present invention provides a method of increased stability when put under increased pressure. The dynamic wedges and bracing method according to the invention is designed to stabilize a structure (building) after reaching the point of catastrophic failure without the invention. It utilizes a dynamic arch stabilizer system, whereby a rigid system (building, arch) which becomes non-rigid (semi rigid) as a collapsing building or disintegrating arch, can regain its rigidity almost instantly.

A wedge is a shape in which two facets (legs, straight (e.g., a triangle) or curved) meet in an angle, the apex opposite a base. Forces exerted on the facets (legs) of a wedge will cause a force vector toward its base. As shown in simplest form in FIG. 1, a dynamic wedge system consists of two opposing wedges connected by a semi-rigid (flexible)

rod. The wedge side (leg) attached to the rod is parallel to ground and the opposite vortex (apex) is on the ground. The bases (B) substantially face each other although not completely as is the case with parallel surfaces, it being understood that a configuration with the bases (B) initially parallel to each other (see FIG. 4B) is within the scope of the invention even though not shown in FIG. 1.

When the system is at rest, it is unstable and the rod is semi-rigid. The system is activated by vertical (perpendicular to ground) force vectors applied on both wedges. Since the system is unstable, it collapses and the wedges rotate around (about) the wedge vortexes which are on the ground. The system stabilizes (almost immediately) when, for each wedge, the leg settles to a second position (FIG. 2) with the leg resting on a support surface, e.g., the ground. When the wedges move to the second position, the flexible rod arches and becomes stable, thereby converting from a semi-rigid state to a rigid a state. When the system settles, the vertical force vectors change direction and form a force vector resultant which generates an inward force vector promoting closure of the arches base and a ground force vector (see FIG. 4C). The net effect is that further increase in compressive force magnitude will stabilize the system, rather than destroy it. This sort of conversion is exhibited by the human foot where the foot arch serves as the flexible (semi-rigid) rod and converts to a rigid arch once activated.

A structure (a building, an arch) using the invention can be induced by the dynamic wedge system to stabilize and convert from a semi-rigid (unstable) state, to a rigid (stable, architectural arch) state. To accomplish that, it must have a degree of plasticity, that is, to transition through a semi rigid state under increase pressure and not go from a rigid state straight to catastrophic failure. Addition of bracing between structure (arches, building) elements with some degree of elasticity, will accomplish that. In a building it could be rebar(s) made of one or various materials (metal, plastic, nylon etc.) with various degree of elasticity. These could envelop the structure (around the outside or shell) and/or reside within it, and may also incorporate some sort of spring mechanism. The rebar(s) usually is/are anchored to the upper wedge on each side of the arch, but need not be, and could instead be anchored to the ground. The dynamic wedges must be placed in accordance to the dynamic wedges stabilization criteria surrounded by a forgiving material/surface, which allows for movement/settling of the wedges when the catastrophic event occurs (e.g., earthquakes); in a more elaborate construction a "dead space" is included around the wedges to accommodate "settling" of the wedges.

The dynamic arch system with rebars according to the present invention, allows for controlled collapse (settling) of a rigid architectural arch (building) into a different kind of rigid arch, an inferior arch compression (IAC) rigid arch. To accomplish that, the arch has to go through a transition state, the semi-rigid arch state, which allows for plasticity in the system. Both arches, the "architectural" rigid arch and the IAC arch are rigid and therefore exhibit arches unique properties of neutralization of opposing ground forces as seen in FIGS. 4A, 4B and 4C.

The system according to the present invention is activated at the catastrophic point where the arch (building) exhausted all built-in and supporting restrains, passive and active. Its purpose is to keep the structure from collapsing, structurally erect, and therefore prevent crushing its contents, that is saving people's lives in the building.

The dynamic wedge system with stacked wedges passive restraints—the "dynamic wedge system passive restraints using stacked wedges", is designed to prevent arch collapse (as opposed to the dynamic wedge system which acts after the collapse—after the catastrophic point) and therefore delay or avoid the catastrophic point. Its purpose is to be a cost effective, efficient, and a standardized system which could (and should) be incorporated into the building code of an earthquake susceptible zone. It is designed to absorb multidirectional erratic force vectors of oscillating intensity (magnitude) and direction as encountered in a severe earthquake. The stacked wedge system is designed to be placed on the natural terrain which can vary in its resistance to displacement depending on its material content, from soft sand to hard rock. Supplemental foundation footing(s) and abutment(s) can be added. In a passive-dynamic wedge system, springs or rods of various strength and at varied angles can supplement "shock absorption" as additional restraints to destructive force vectors prior to the catastrophic point. A more elaborate (and more expensive) system is an active-dynamic wedge system whereby a seismic monitor activates a "restraining system" in the form of hydraulic pumps or piston engines (or similar mechanism), which add active counterforce vectors, acting as a dynamic "shock absorber", delaying and hopefully preventing collapse.

The wedges could be concrete (or any similar material) and of various sizes, dimensions and apex angles. They are preferably in the shape of a wedge block so they can exert wedges force vectors re-alignment, whereby a force vectors applied on wedges legs create a resultant force vector at wedge's base. In one embodiment (see FIGS. 8A and 8B) four wedges (or more) are stacked with the base of the upper and lower face in one direction and the inner wedge bases in the opposite direction forming a rectangular (or square) block. The wedges are not bound but might have an inter spacing material. The upper wedge attaches to the arch (building) in some commonly known manner (ex: fixation bolts) and to the rebars which allows them to act in unison when the semi-rigid state is activated at the catastrophic point. The lower wedge sits/rests on the ground and in a more elaborate (and expensive) construction, the wedge can be part of a concrete footing or slab. Prior to the catastrophic point, the wedges will absorb multidirectional force vectors, however, the middle (inner) two wedges will be displaced once all potential (internal structural and external (springs, abutments)) absorption capacity is exhausted. As the inner wedges displace, the system settles and the upper wedge, the one attached to the arch settles, gradually or suddenly, rotating clockwise or counterclockwise (depending on the side) with the fulcrum at wedge apex opposite wedge leg attached to the arch. A cylinder and trough (gutter)—ball and socket—or similar mechanism at the adjoining apexes of the upper and lower wedges provide the rotational fulcrum point. As upper wedge settling proceeds, the rigid architectural arch gains plasticity (becomes more unstable) and enters the semi-rigid state. When the settling is completed, upper wedge's opposing arch leg is resting on solid ground (or the inferior wedge), the semi-rigid arch gains inferior arch compression (IAC) properties and since it is rigid, exhibits rigid arch unique properties of neutralizing opposing ground forces, stabilizing the building (arch). The net effect is that the structure (arch, building) remains erect, force vectors are re-directed by wedge's properties inward, shortening arch base and therefore making it more stable. A further increase in force magnitude stabilizes the arch rather than destroying it.

Another embodiment of the invention includes a piston and engine or hydraulic pumps (using water or oil) which are activated by a seismic-gage depending on the strength of earthquake it is set to.

Preferably, the system according to the invention includes a hinge on the concrete wedge, upper wedge cylinder (ball) on lower apex and the lower wedge a grove (socket) in its upper apex. They act in unison as a hinge to guide the wedges collapse.

In yet another embodiment, the dynamic arch system includes springs. A "neutral" semi-rigid arch is one that can be stretched or compressed. At the extremes it becomes rigid and exhibits the rigid arch's unique properties of ground force neutralization. This is a "spring like" effect whereby the kinetic energy (KE) input (stretching and/or compression) is converted to potential energy (PE) stored in the deformed arch. A stretched arch brings about superior arch compression (SAC) and a compressed arch inferior arch compression (IAC). During fluctuation of the semi-rigid arch, as in a foot arch, the transition (e.g., from sac (during the stance phase of the gait cycle) to neutral arch (during the swing phase) to IAC (during the windlass effect)) is the "natural" mechanism of shock absorption. The fluctuation (oscillation) between different types of rigid arches with intervening semi-rigid states and the conversion of KE to PE and vice versa, create the "Engine" effect of a machine converting gravitation energy to mechanical motion. This is the "shock absorption" mechanism found in the foot. In the foot, dynamic arches bio-mechanism during the gait cycle brings about SAC during the stance phase, with "Neutral" Arch during Heel Off phase, IAC during Windlass phase and "Neutral" arch again during Swing and Heel Strike phases. The invention uses a similar "Shock absorption" mechanism whereby KE is converted to PE in an alternative type of Arch deformation. As described for the foot, the invention works in a similar manner by altering arches (E-Spring) state from one kind of rigid arch (SAC) to semi-rigid transition state to another type of rigid arch IAC, hence, the "Engine" effect. The E Spring—The E (Earthquake) Spring is designed to take advantage of the dynamic arch systems unique properties which distinguishes it from conventional springs and other shock absorption modalities used to stabilize a structure during an earthquake. It keeps a leveled height (Y), leveled ground, throughout the earthquake while functioning continuously as a shock absorber spring, converting KE to PE and vice versa, dissipating earthquake forces. The E Spring is set "dormant" as a SAC rigid arch under a leveled structure (building) base. When activated, either passively or by a seismic sensor, it oscillates (fluctuates) between SAC rigid arch and IAC rigid arch with semi-rigid arch states in between. This is the "spring" action of energy absorption and dissipation. Since arch height (Y) remains constant, structure (building) base (foundation) is leveled (straight) at all times.

BRIEF DESCRIPTION OF THE DRAWINGS

The accompanying drawings, which are incorporated in and constitute a part of this specification, illustrate embodiments of the invention and, together with the general description of the invention given above and the detailed description of an embodiment given below, serve to explain the principles of the present invention. Similar components of the devices are similarly numbered for simplicity.

FIG. 1 shows two wedges on opposing sides of a flexible member with each wedge on its apex. The arch structure in FIG. 1 is a semi-rigid arch. When force is applied on the wedges just outside the point above the apex, the wedges rotate until the legs rest flat on the surface (ground) causing the flexible member to bend in a rounded arch-like fashion forming a rigid arch. FIG. 3A shows the transitioning from the semi-rigid to the rigid arch with the in-between positions in dashed lines. FIG. 3A shows potential energy stored in the arch is released causing a spring-like effect.

FIGS. 7A and 7B also show a structure without the invention and the effect of an earthquake on the various structures including the rotation of the wedges and the formation of a rigid arch in the embodiments according to the present invention.

DETAILED DESCRIPTION OF THE INVENTION

Reference is being made in detail to presently preferred embodiments of the invention. Selective embodiments are provided by way of explanation of the invention, which is not intended to be limited thereto. In fact, those of ordinary skill in the art may appreciate upon reading the present specification and viewing the present drawings that various modifications and variations can be made.

Figure 7A:
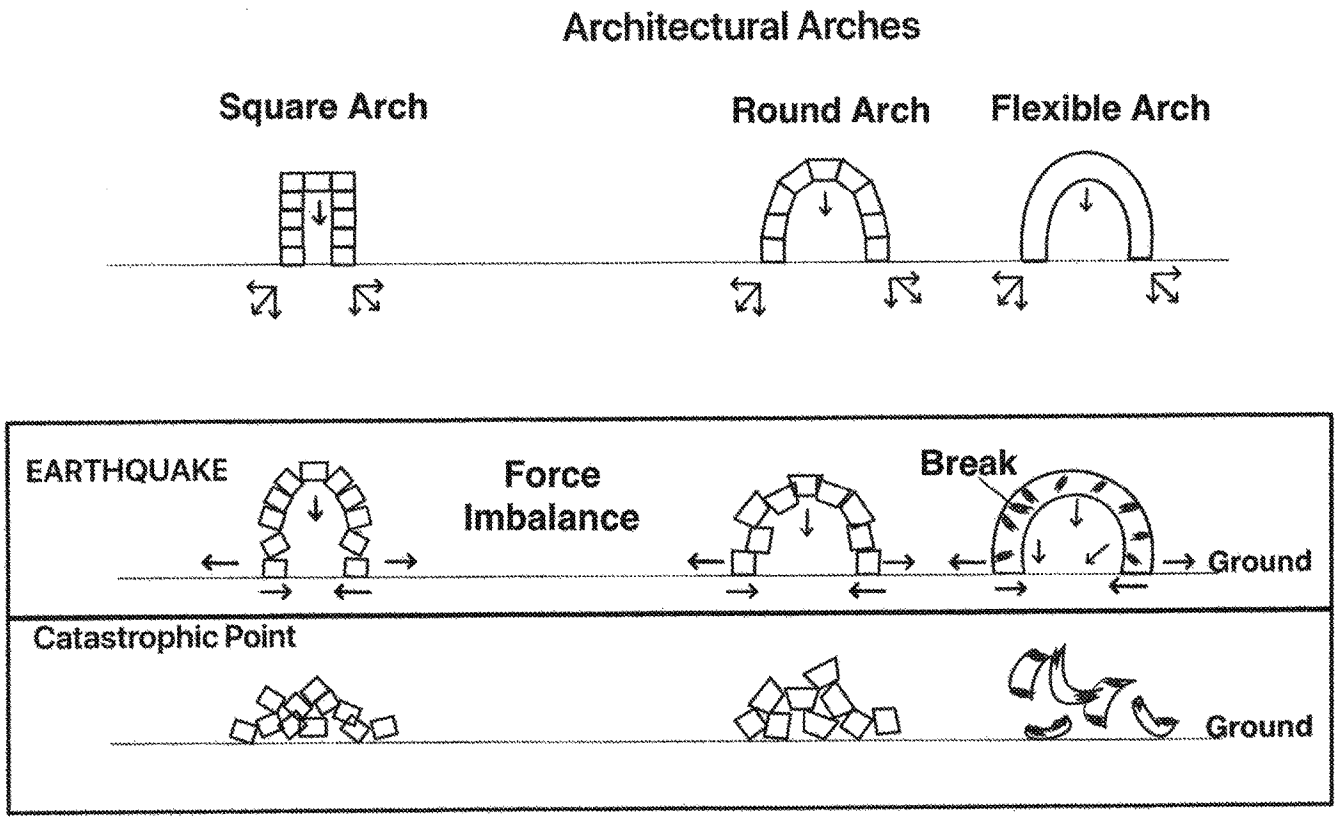
FIGS. 7A and 7B show different embodiments of the invention with the flexible member (comprised of one element of a plurality of flexible elements connected together) including embodiments with external bracing (rebars on the outside of the structure—one with springs and one without springs) and one with internal bracing (rebars within the structure's elements).
Figure 7B:
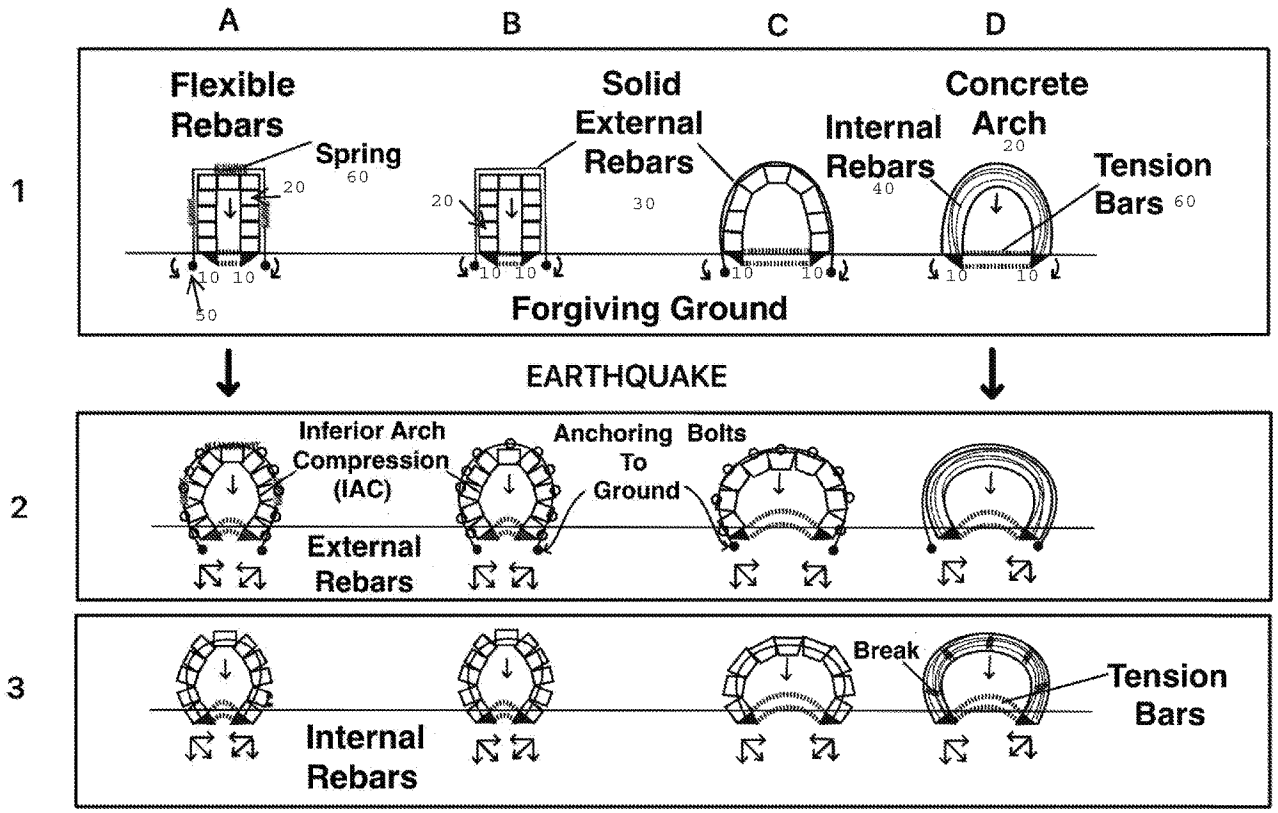

The present invention is a dynamic arch system comprising a plurality of triangular-shaped footings 10 located underneath two opposing sides of a foundation wall 20 for a structure. As shown in FIGS. 7A and 7B, the triangular (or wedge shaped) footings 10 could be positioned under the two sides of an arch structure 20, e.g., under two opposite walls of a building structure. FIGS. 7A and 7B show profile views of the invention in a two dimensional plane. The present invention of course includes length in the third dimension into and out of the page. The length of the triangular-shaped footings 10 beneath the foundation walls 20 could vary anywhere between the entire length of the foundation wall and some shorter distance. The design of the actual length of the triangular-shaped footings 10 according to the invention will depend upon the particular size and design of the structure 20 itself, including geologic conditions. The present invention also includes embodiments with multiple pairs of wedge/triangular-shaped footings 10 on opposite sides of a foundation 20 even though such embodiments are not expressly shown in the figures.

All of the embodiments in FIGS. 7A and 7B show one pair of triangular shaped footings 10 beneath opposing sides of the building structure 20. Other embodiments for systems with multiple triangular shaped footings 10 in each location, not just one, are shown in FIGS. 8A, 8B, 9, 10A and 10B. FIGS. 7A and 7B also show two different embodiments of the invention comprising one pair of triangular shaped footings 10 beneath opposing sides of the building structure 20: one embodiment with external bracing 30 around the outside of the building structure and one embodiment with internal bracing 40 within the building structure 20. As stated above, the flexible bracing 30 is made from a flexible material that can bend, such as, for example, rebar or high tension wire. For the embodiments with external bracing 30, the flexible bracing is preferably attached to the outside of the building 20 at a plurality of locations as seen in FIGS. 7A and 7B. For the embodiments with internal bracing, the flexible bracing 40 is fixedly connected within the walls of the structure, e.g., rebar within concrete walls. Preferably, the flexible bracing (30 or 40) is a single flexible member made from a plurality of rebars fixedly connected together to form one flexible brace. For both embodiments shown in FIG. 7A, the flexible bracing (30 and 40) is fixedly attached at both of its ends to anchoring bolts 50 positioned beside and/or beneath the triangular shaped footings.

Figure 1:
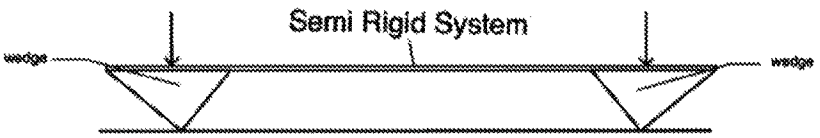
FIGS. 1, 2, 3A and 3B show the basic elements of the dynamic arch system according to the present invention.
Figure 2:
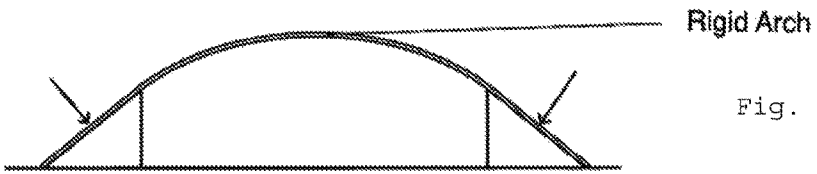
Figure 3A:
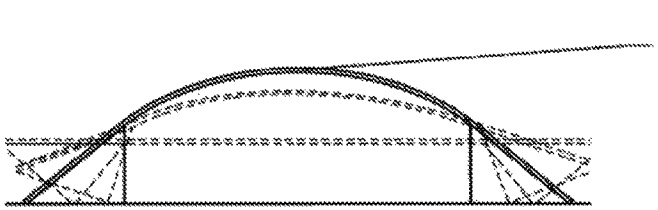
Figure 3B:
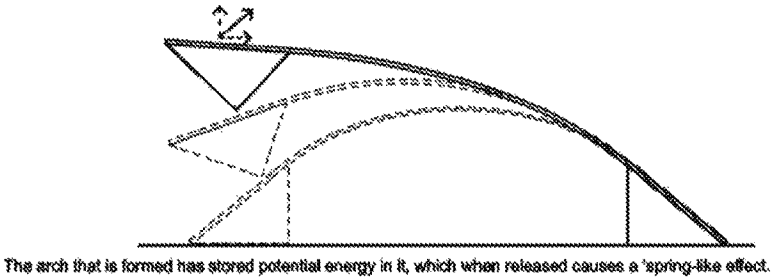
Figure 4A:
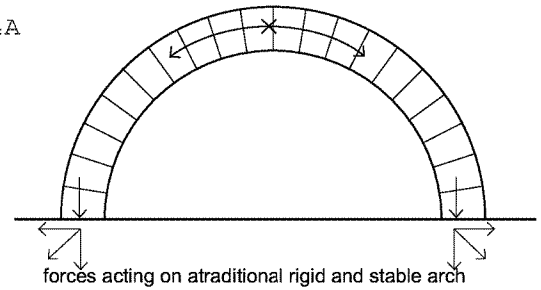
FIGS. 4A, 4B, 4C and 4D also show the principles behind the dynamic arch support system including the transition of the structure through a semi-rigid arch state to a rigid state with IAC with neutralization of opposing ground forces.
Figure 4B:
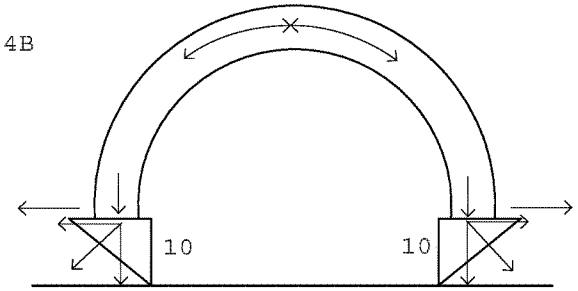
Figure 4C:
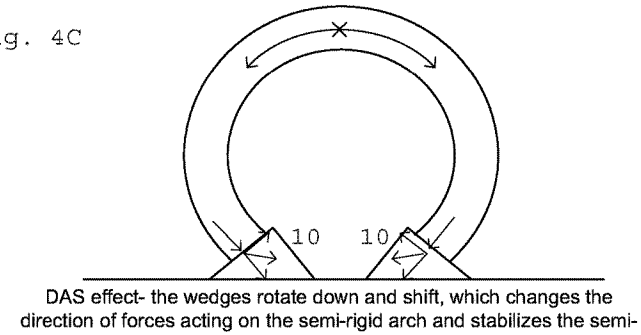
Figure 4D:
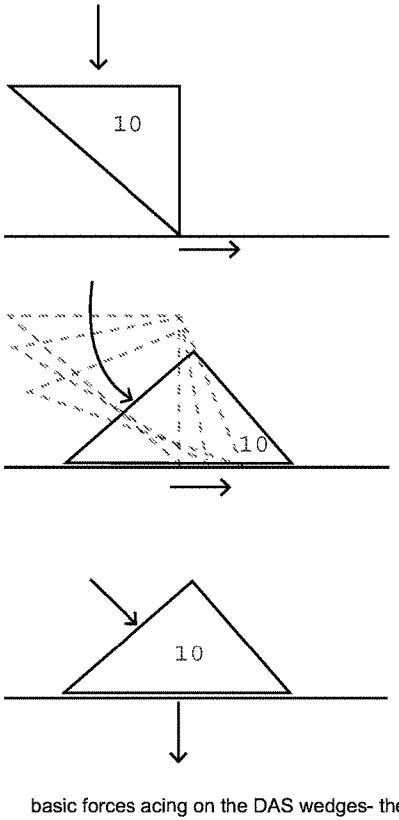
Figure 5:
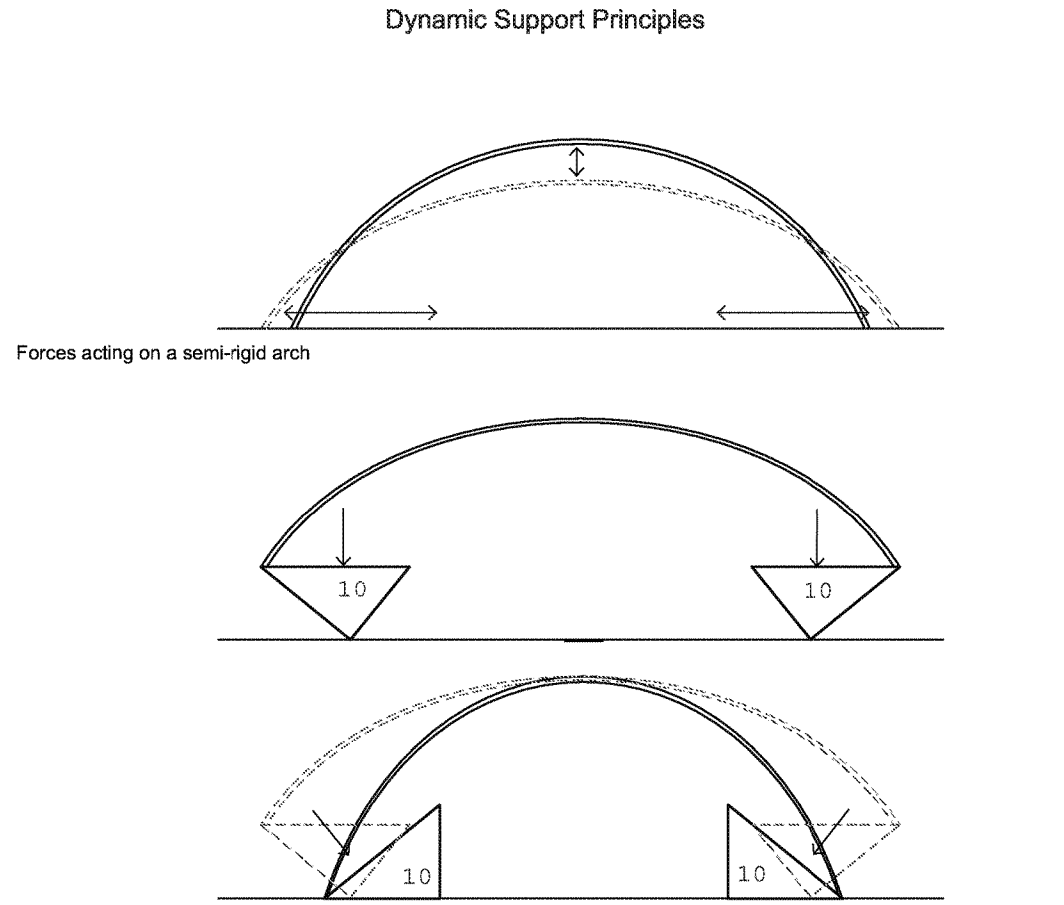
FIG. 5 shows another example of the dynamic arch system with the flexible member connected at a corner of the wedge instead of along an entire edge.
Figure 6:
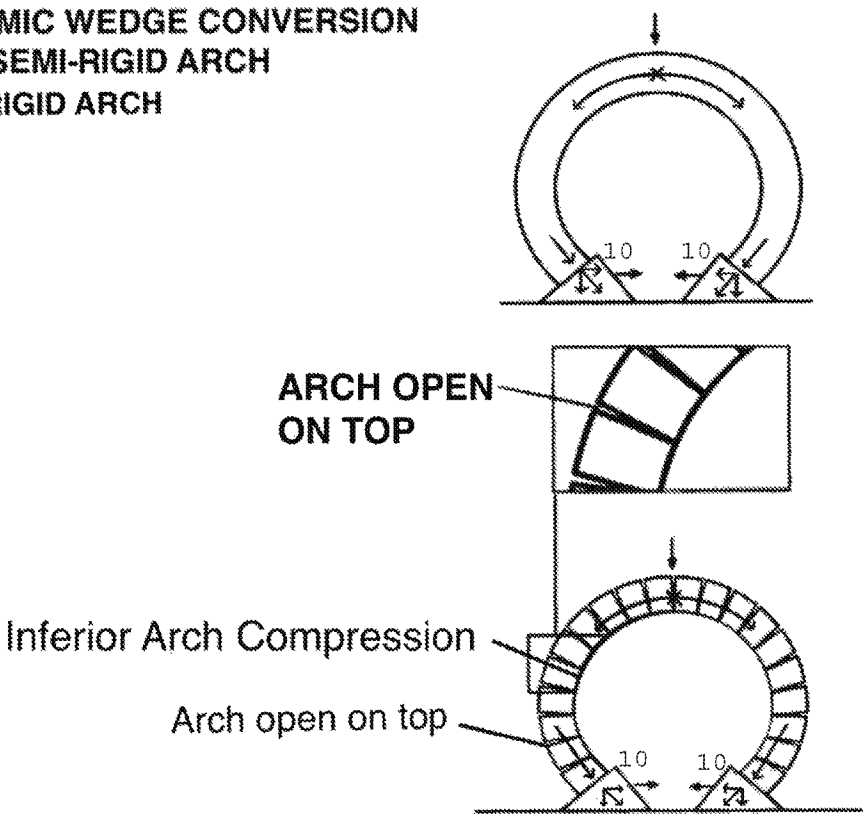
FIG. 6 shows another example of the dynamic arch system with the flexible member connected at a leg of the wedge with the arch in a rigid arch position. The arch is "open" on the outside (on top) with a small gap in between member units of the arch and "closed" on the inside (on bottom) with the member units in direct contact with each other; inferior arch compression.

As shown in FIGS. 7A and 7B, the triangular-shaped footings 10 are capable of rotating from a first position (1) with a corner at the lowest point vertically to a second position (2 or 3) with a corner at the highest position vertically. Put another way, each triangular-shaped footing 10 is capable of rotating on a corner it originally rests and stops rotating when a side (leg) comes to rest on a flat surface, preferably a horizontal flat surface located at the same height vertically as the original height of the lowest point in the first position. The space where the triangular-shaped footings rotate can be empty space (as seen in FIG. 4D) or it can be engineered to contain a compressible material, or it can be engineered to vacate a material or substance upon an event triggering the rotation of the triangular-shaped footings.

The present invention includes embodiments with multiple pairs of triangular-shaped footings 10 on the same set of opposite sides of a foundation 20 even though such embodiments are not expressly shown in the figures.

Figure 8A:
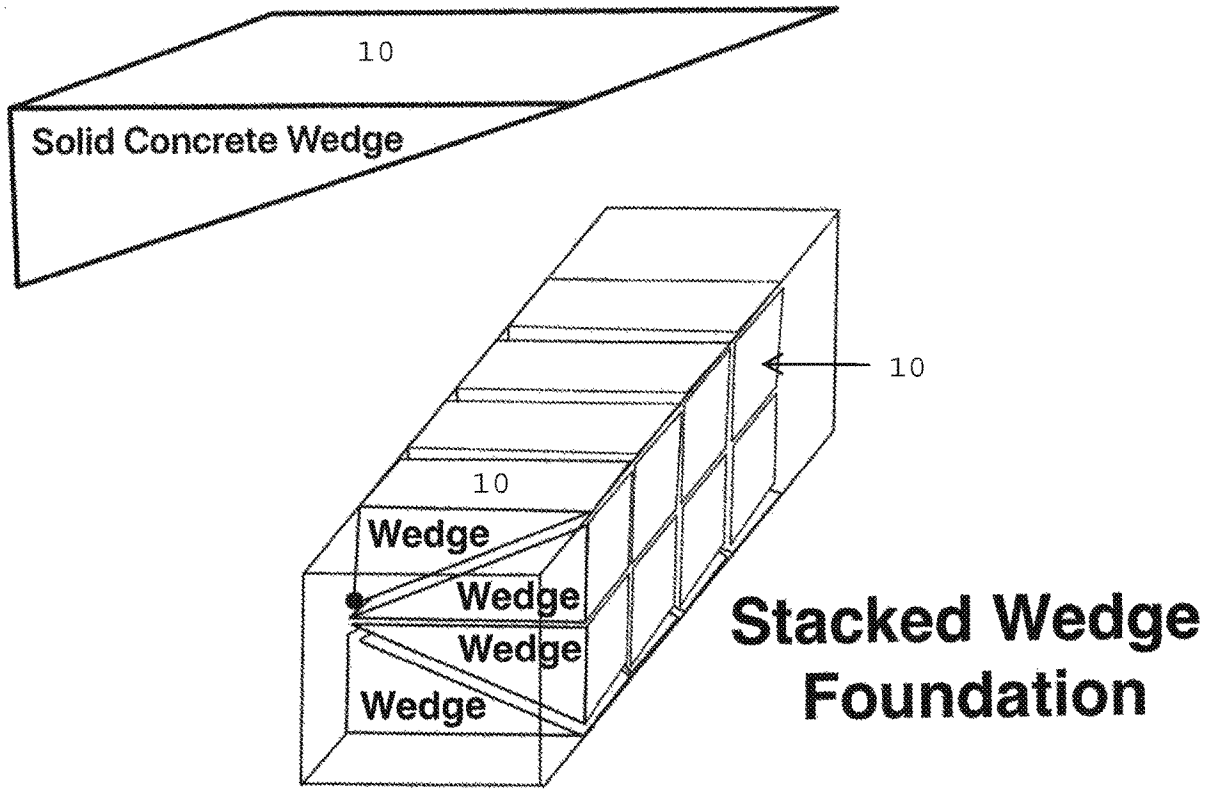
FIGS. 8A, 8B, 9, -10A and 10B show multiple embodiments of the stacked wedge version of the invention wherein at least one displaceable triangular shaped footing element is added beneath the first pair of opposing triangular-shaped footings.
Figure 8B:
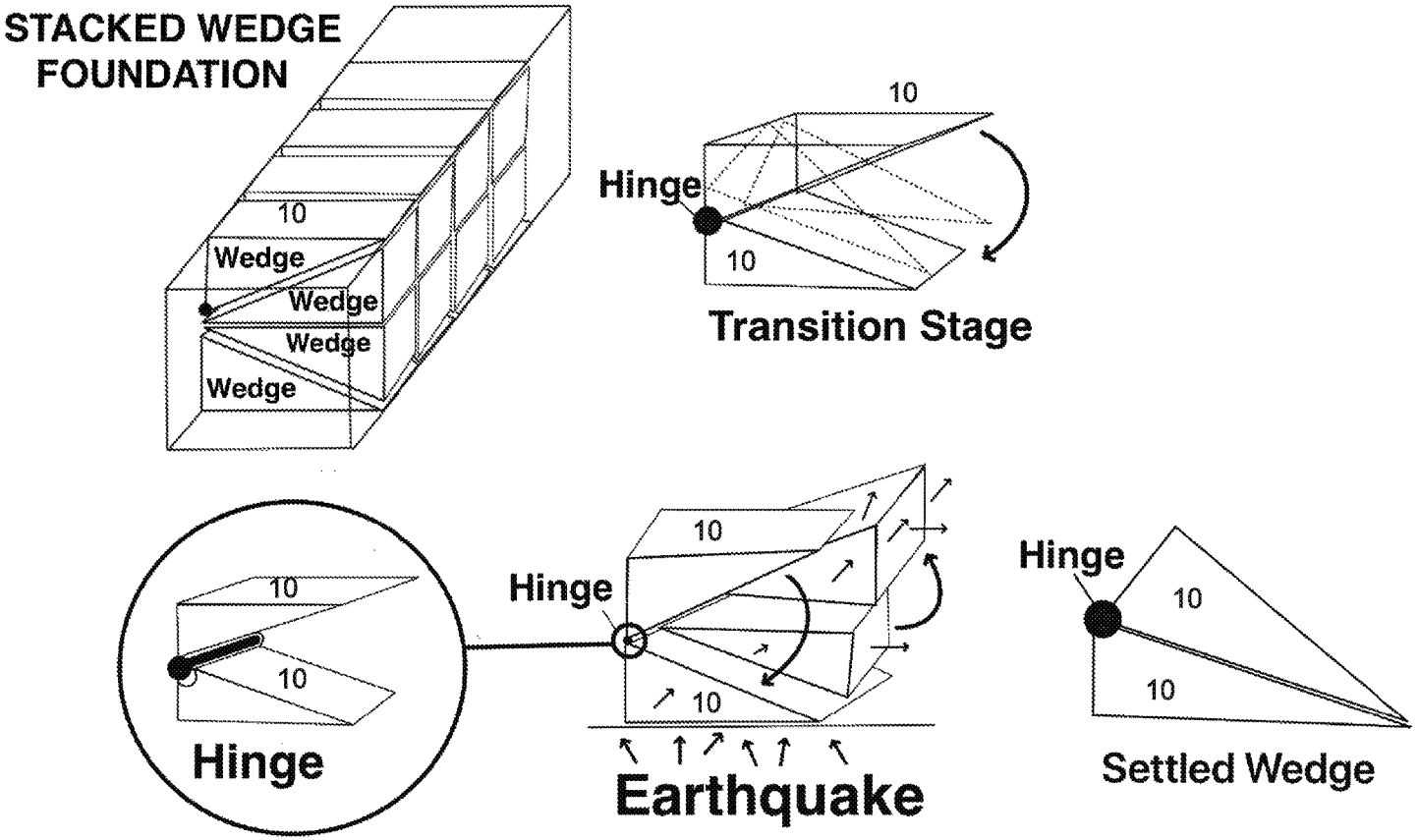
Figure 9:
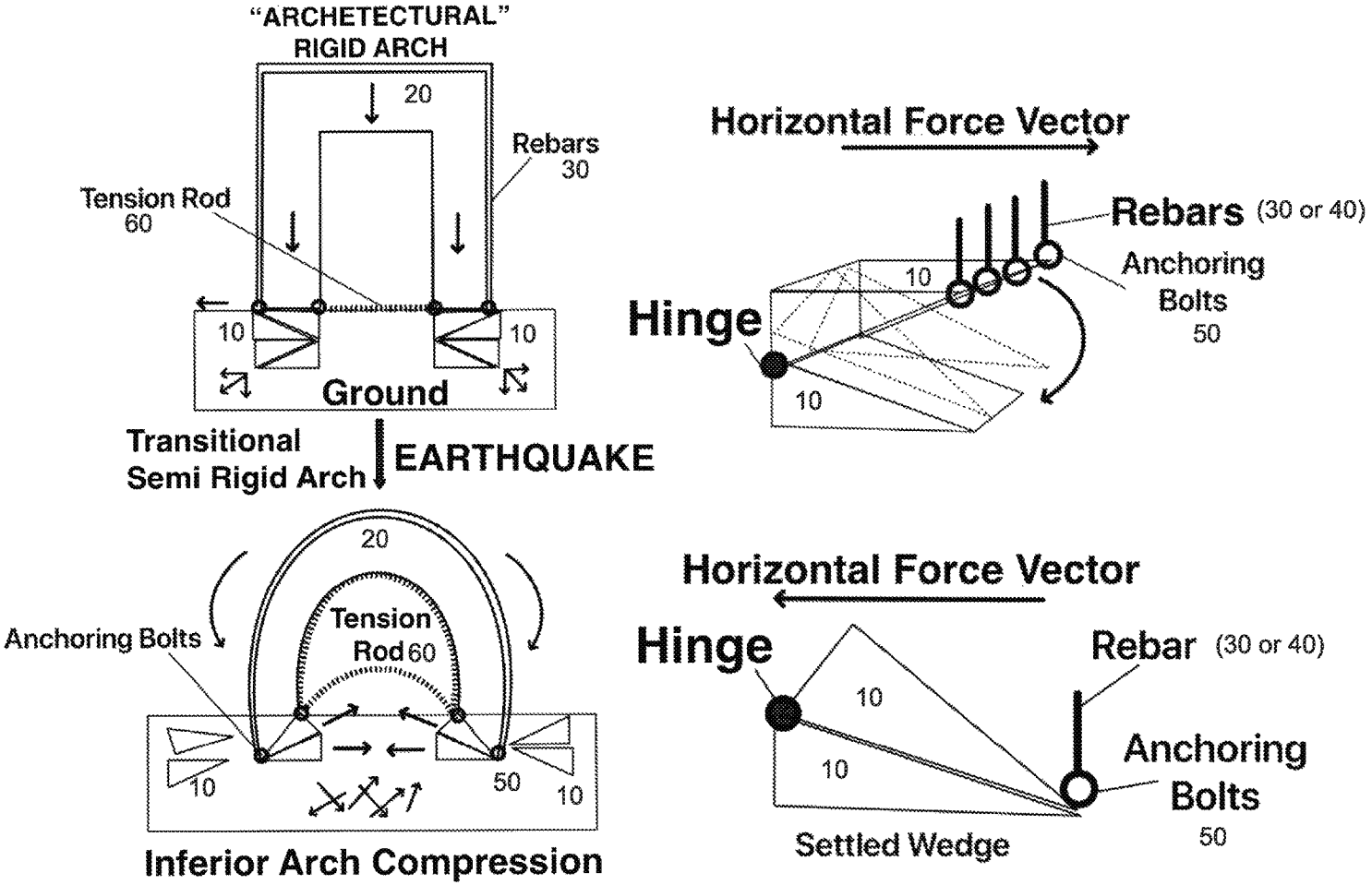
Figure 10A:
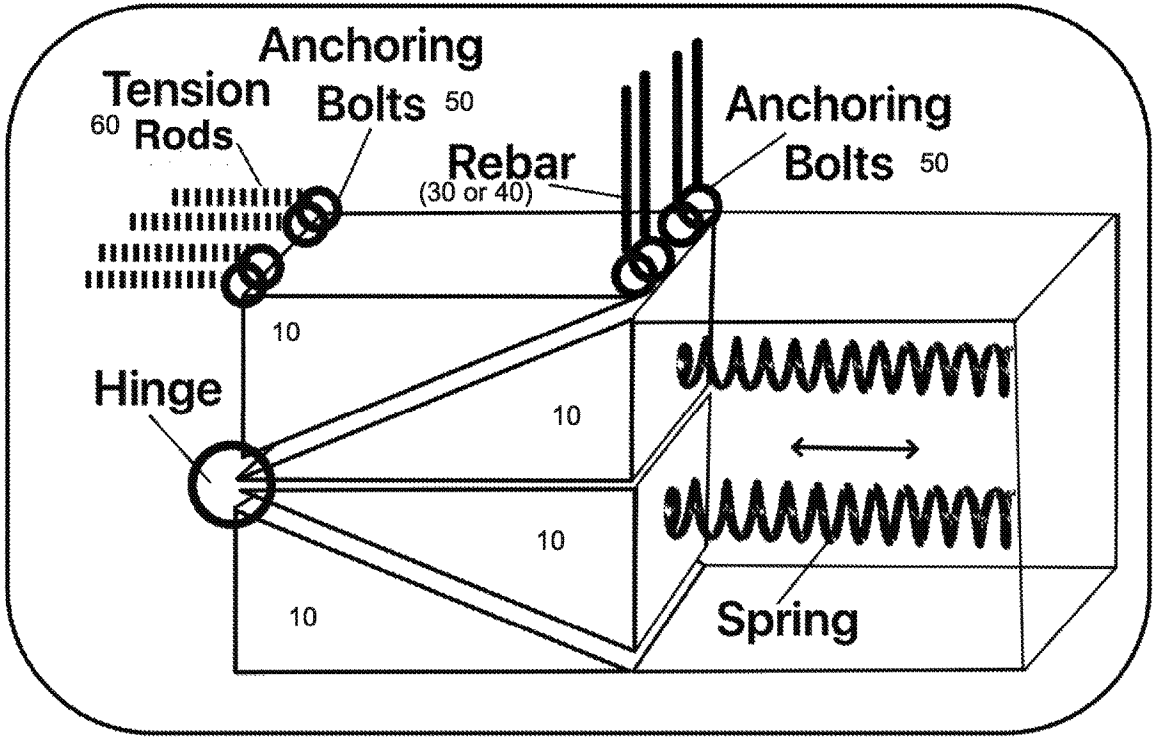
Figure 10B:
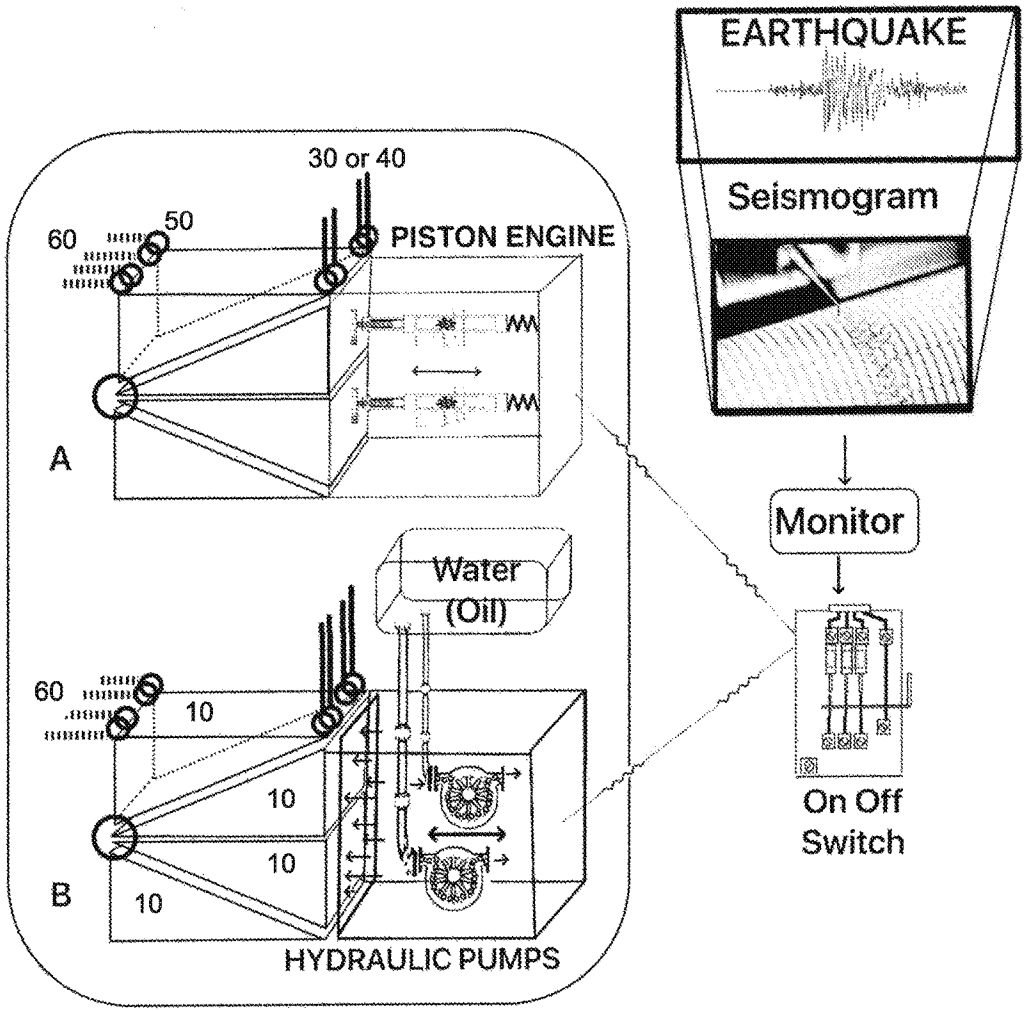

FIGS. 8A, 8B, 9, 10A and 10B show multiple embodiments of an alternative embodiment of the invention with stacked wedges (triangular shaped footings) 10 at each location where there is a rotatable wedge 10. The stacked wedge version of the invention includes at least one displaceable triangular shaped footing element 10 added beneath the first pair of opposing triangular-shaped footings 10. All of the embodiments shown in FIGS. 8A, 8B, 9, 10A and 10B show two displaceable triangular shaped footing elements 10 in a stacked set of four elements it being understood that the invention includes other versions, such as, one displaceable triangular shaped footing element 10. Each displaceable triangular shaped footing 10 is designed to move upon a triggering event (e.g., a seismic event causing a certain amount of ground force) causing the displaceable triangular shaped footing element(s) 10 to move thereby allowing the uppermost triangular shaped footing element to rotate as in the prior embodiments. As shown in FIGS. 10A and 10B, the movement of the displaceable triangular shaped footing element(s) is not limited to the vertical/horizontal plane. Rather, the displaceable triangular shaped footing element(s) 10 could also move in the third dimension vacating the space under the upper most rotatable triangular shaped footing element(s) 10 thereby allowing them to rotate. Such an embodiment is particularly useful for the design shown in FIGS. 8A and 8B with the structure's foundation walls 20 positioned outside the positions of the stacked wedges.

As stated above, and as shown in FIGS. 8A, 8B and 9, the space where the upper most triangular-shaped footings 10 rotate can be empty space or it can be engineered to contain a compressible material, or it can include springs, or the system can include a mechanism (e.g., seismic monitor/sensor) to vacate a material or substance (e.g., hydraulic fluid) upon an event triggering the rotation of the triangular-shaped footings.

The embodiments shown in FIGS. 8A, 8B, 9, 10A and 10B show flexible tension rods (springs) 60 connecting a pair of opposing uppermost rotatable triangular shaped footing element(s) 10 on opposite sides of the structure. It is understood that those flexible tension rods 60 can be made of the same materials as the flexible bracing.

We claim:

1. A dynamic arch system comprising a plurality of triangular-shaped concrete footings located underneath two opposing sides of a foundation wall for a building structure, said concrete footings on opposite sides of said structure connected to each other by at least one flexible member positioned along the outside of said foundation wall between said concrete footings;

wherein said triangular-shaped concrete footings are capable of rotating from a first position with a corner at the lowest point vertically to a second position with a corner at the highest position vertically.

2. The dynamic arch system according to claim 1, wherein said flexible member is a single flexible member comprising a plurality of rebars fixedly connected together to form one flexible member.

3. The dynamic arch system according to claim 1 comprising at least two segments of flexible members between each pair of triangular-shaped concrete footings, further comprising a spring connected between said two segments of flexible members.

4. A dynamic arch system comprising a plurality of triangular-shaped concrete footings located underneath two opposing sides of a foundation wall for a building structure, said dynamic arch system further comprising at least one flexible member positioned along the outside of said foundation wall fixedly connected to anchoring bolts located adjacent to and beneath said triangular-shaped concrete footings;

wherein said triangular-shaped concrete footings are capable of rotating from a first position with a corner at the lowest point vertically to a second position with a corner at the highest position vertically.

5. The dynamic arch system according to claim 4, wherein said flexible member is a single flexible member comprising a plurality of rebars fixedly connected together to form one flexible member.

6. The dynamic arch system according to claim 4 comprising at least two segments of flexible members between each pair of triangular-shaped concrete footings, further comprising a spring connected between said two segments of flexible members.

7. A dynamic arch system comprising a plurality of triangular-shaped concrete footings located underneath two opposing sides of a foundation wall for a building structure, said concrete footings fixedly attached to said foundation walls, said dynamic arch system further comprising at least one flexible member positioned within walls of said foundation wall fixedly connected to anchoring bolts located beneath said triangular-shaped concrete footings;

wherein said triangular-shaped concrete footings are capable of rotating from a first position with a corner at the lowest point vertically to a second position with a corner at the highest position vertically.

8. The dynamic arch system according to claim 7, wherein said flexible member is a single flexible member comprising a plurality of rebars fixedly connected together to form one flexible member.

* * * * *